United States Patent [19]

Colyer et al.

[11] Patent Number: 4,552,606

[45] Date of Patent: Nov. 12, 1985

[54] FLOTATION METHOD FOR ORIENTING CHIPS IN THE MANUFACTURE OF SURFACE COVERING

[75] Inventors: Timothy D. Colyer, Columbia; Darryl L. Sensenig, Mountville, both of Pa.

[73] Assignee: Armstrong World Industries, Inc., Lancaster, Pa.

[21] Appl. No.: 473,016

[22] Filed: Mar. 7, 1983

[51] Int. Cl.[4] ..... B32B 5/16

[52] U.S. Cl. ..... 156/280; 156/246; 156/302; 156/305; 156/278; 427/222; 427/348; 264/112; 264/128; 264/298

[58] Field of Search ..... 156/243, 246, 71, 297, 156/302, 305, 62.2, 289, 280, 278, 285, 300, 301; 264/DIG. 57, 112, 128, 122, 212, 298, 108, 109, 124, 25, 126, 138, 117, 165, 261, 299; 428/407, 156, 46, 48; 427/212, 214, 220, 348, 222

[56] References Cited

U.S. PATENT DOCUMENTS

| | | | |
|---|---|---|---|
| 3,056,224 | 10/1962 | Almy et al. | 156/71 X |
| 3,150,022 | 9/1964 | Vida | 156/241 X |
| 3,551,244 | 12/1970 | Forester et al. | 156/246 |
| 3,661,662 | 5/1972 | Allen | 264/298 X |

OTHER PUBLICATIONS

Rickard, T. A., Concentration by Flotation, John Wiley and Sons, N.Y., 1921, pp. 45–49, TN 523R45.

*Primary Examiner*—Edward Kimlin
*Assistant Examiner*—Ramon R. Hoch

[57] ABSTRACT

A substantially non-overlapping tightly packed layer of plastic chips is formed and attached to the surface of a substrate by a method in which the chips are dispersed onto the surface of a liquid, flowing from a first location to a second location. The rate of flow of the surface of the liquid is reduced at the second location to cause the chips to pack together in a single-chip-thickness layer. The layer of chips is then removed from the liquid by passing a porous web upward at an angle from below the liquid surface through the chip layer-liquid interface. The chip layer is then transferred to a heat-sensitive transparent adhesive coating on a suitable prepared substrate and secured thereon by means of heat and pressure. A resinous wear layer which is transparent after fusion is then applied. Prior to fusion of the wear layer, it may be passed beneath a smoothing blade or, if a more embossed surface texture is desired, beneath an air knife to move some of the resinous wear layer material from between the chips onto the surfaces thereof.

2 Claims, 4 Drawing Figures

FLOTATION METHOD FOR ORIENTING CHIPS IN THE MANUFACTURE OF SURFACE COVERING

BACKGROUND OF THE INVENTION

1. Field of the Invention

This invention relates to a method for making sheet material and more particularly, to a flotation method for forming a plurality of very thin, flat, pre-formed design pattern elements into a tightly-packed single layer, and the application thereof to a substrate prior to consolidation of the material into a finished product such as a floor or wall covering.

2. Description of the Prior Art

In the production of vinyl type floor and wall coverings in which the decorative wear surface includes, or is comprised of, a plurality of small pre-formed pattern elements positioned on a backing in close proximity to one another with the area between adjacent elements filled with a plastic material, the common practice has been to place a thin layer of design elements on a traveling substrate and, by imparting a vibratory motion thereto, orient the pattern elements with respect to one another in an arrangement wherein they form a single layer with the elements touching each other at at least one point on their peripheries. The application of vibratory motion to the substrate and pattern elements thereon is required to move the elements into a uniform arrangement one element thick because it is very difficult, using prior pattern element feeding means to avoid having pattern elements overlap or being disposed upon one another or having relatively large gaps between adjacent pattern elements. U.S. Pat. No. 3,056,224 exemplifies this type of operation. U.S. Pat. No. 3,150,022 discloses another arrangement for forming a single layer of flat pre-formed design elements prior to their application to a backing. In this arrangement, a randomly spaced arrangement of the elements are fed onto a first moving belt which carries them under a plate extending across the width of the belt. The plate is spaced away from the belt a distance only slightly greater than the thickness of one of the pattern elements to allow only a single thickness layer of the elements to pass thereunder. The pattern elements are then moved onto a second belt moving at a speed below that of the first belt. This causes the elements to bunch up into a tightly packed single thickness layer which is then secured to a backing. Other related variations of this type of operation are disclosed in U.S. Pat. Nos. 3,323,935; 3,012,901; and 3,540,411.

Prior methods of orienting chips on the surface of a substrate have not been entirely satisfactory in that when the vibratory method of orienting the chips was used, there was a lack of positive control of the spacing between the chips and/or control of the overlapping of the chips. Passing of the chips on a moving carrier under a plate spaced away from the carrier a distance only slightly greater than the thickness of the pattern elements has proven to be unsuccessful when thin chips such as those of the present invention are used in that the chips tend to clog up under the scraper and tend to ride up over each other when the rate of movement of the carrier is slowed and there is no certainty of control over spacing of the chips with relation to each other.

As disclosed by U.S. Pat. No. 3,679,784, it is known to form decorative articles suited for incorporation into polymeric flooring materials such as vinyls by placing and spreading quantities of different-colored plastisol on a body of liquid immiscible with the plastisol and having a density in excess of that of the plastisol. The separate bodies of plastisol may be brought together so that the juxtaposed inner edges thereof meet at irregular but clearly defined interfaces. The plastisol may be gelled and fused while it is on the support liquid and may be removed therefrom by bringing the substrate into surface contact with the liquid plastisol and then lifting the substrate.

U.S. Pat. No. 3,551,244 discloses a film laminate producing method wherein a polymer solution is dispersed on a water surface to form a film. The film is then removed continuously from the water surface by a support member which passes upward from below the water through the film-water interface so that the film adheres to the support member. The film may be broken into flakes before removal. The depth and rate of flow of the water may be used to control film formation.

The problem not solved by the prior art is how to form a plurality of small, very thin, pre-formed flat chips of differing colors, shapes and dimensions into a tightly packed layer of randomly arranged design elements and apply this layer to a substrate to obtain a surface having a thickness equal to that of a single chip and having substantially no overlaps or excessive spaces between the chips. This problem is solved by the present invention.

SUMMARY OF THE INVENTION

This invention relates to a method for forming a tightly packed, thin, single-chip-thickness layer on the surface of a substrate by dispersing a plurality of non-wettable thin, flat chips or flakes onto the surface of a liquid flowing in a given direction at a given rate and then reducing the rate of flow of the liquid to cause the chips to pack together in a single-chip-thickness layer. The layer of chips is then removed from the liquid without disturbing their orientation by passing a porous web support member upwardly through the chip layer-liquid interface. The chips are then transferred to a transparent adhesive coating on a suitable prepared substrate and attached thereto by means of heat and pressure.

It is an object of the invention to provide a surface covering having a decorative chip wear surface. It is a further object of the invention to provide such a surface covering wherein the chips on the decorative wear surface are tightly packed together in a layer which has a uniform thickness equal to the thickness of each of the chips forming the layer.

Another objective of the invention is to provide such a decorative chip layer which is composed of thin, preformed flat chips or flakes of differing colors, shapes and dimensions arranged in a random design with substantially no overlaps or excessive spaces between the design elements.

Another object of the invention is to provide such a decorative chip layer which is substantially devoid of overlapping chips. A still further object of the invention is to provide a method for forming such a surface covering and the decorative chip layer thereon whereby more positive control of the spacing of the chips may be achieved.

DESCRIPTION OF THE PREFERRED EMBODIMENT

Figure 1:
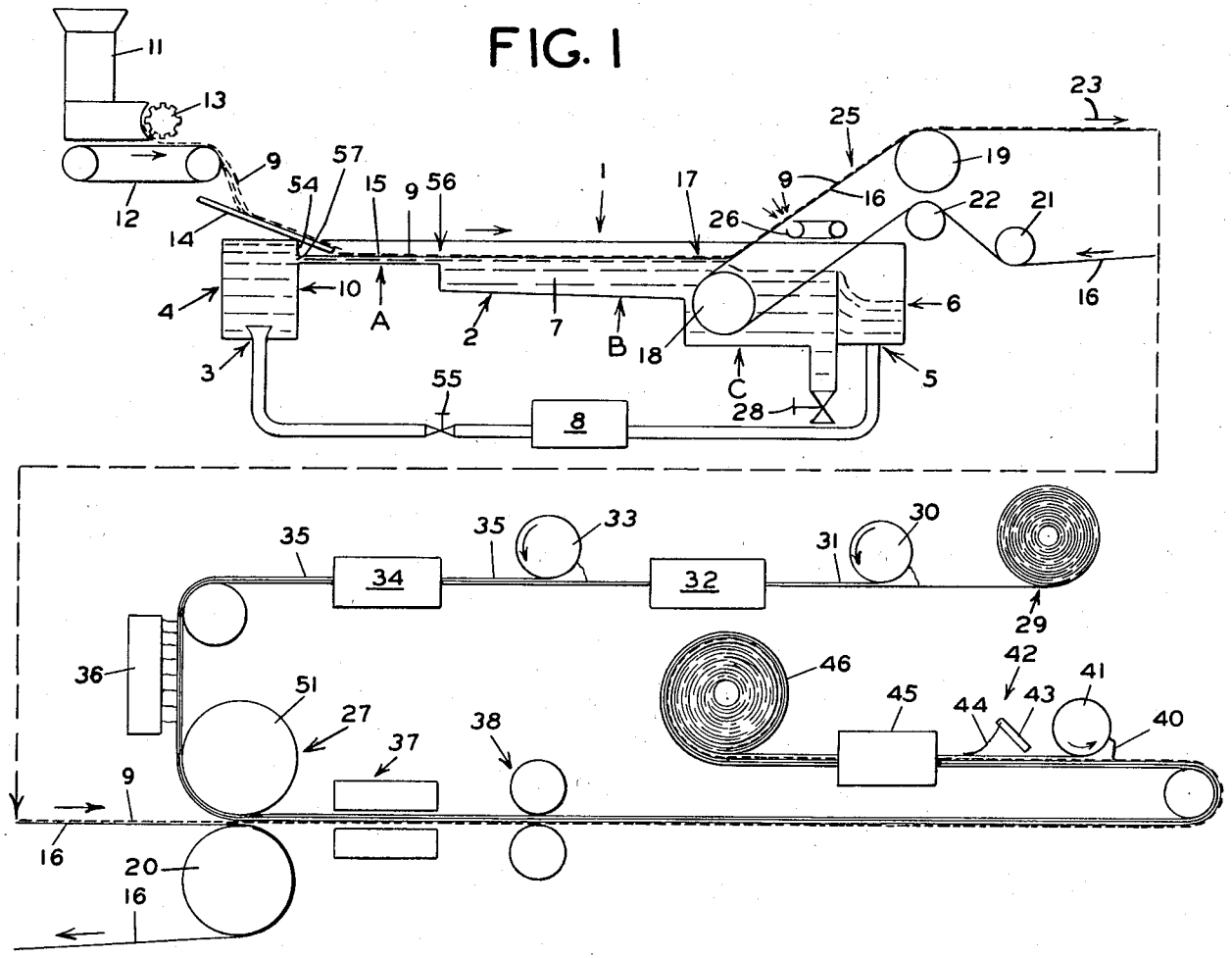
FIG. 1 is a diagrammatic illustration of the apparatus for carrying out the process of this invention.

Referring to the drawings, there is shown in FIG. 1 an apparatus for carrying out the process of this invention in a continuous manner. As shown in FIG. 1 the apparatus designated generally by the reference numeral 1 includes a tank 2. A liquid inlet 3 is provided at the one end 4 of the tank 2 and an outlet 5 for the liquid is provided at the other end 6 thereof. The liquid 7 may be circulated through the tank 2 by means of a suitable pump 8 positioned between the liquid outlet 5 and the inlet 3. A valve means 28 is provided for draining the liquid 7 out of the tank 2.

In the preferred embodiment of the invention the liquid must have a suitable density and surface tension so that the chips 9 will be held afloat thereon.

It has been discovered that chips such as thin, non-wettable vinyl chips having a size-to-mass ratio such that they may be supported on the surface of a liquid of lesser density than that of the chips may be dispersed on the surface of such a flowing liquid and held thereon by the surface tension. The chips float on the surface of the liquid rather than in it and move thereover with great ease.

In this embodiment the liquid 7 is water and the chips being fed thereonto are preferably about 8 mils thick and have at least one dimension in the range of from 1/32 inch to 1 inch. The water 7 is pumped by means of a pump 8 into portion 10 of the tank 2. A valve 55 is provided to regulate the flow of water from pump 8 into portion 10 of the tank 2. The water flows from portion 10 into section A of the tank 2 at a rate predetermined to assure an adequate loosely packed dispersion of the chips 9 on the surface of the water 7 when they are fed thereonto. The flow rate of the water across section A of the tank 2 is controlled by flow restricting member 54 having an opening 57 therein. By filling portion 10 of the tank 2 with water and regulating the size of opening 57, a high velocity flow of water across section A of the tank may be achieved.

The chips are metered from a hopper 11 onto a belt 12, leveled, and again metered by means of a fluted roll 13. The chips are then fed from the belt 12 onto an inclined vibrating slide tray 14 to cause initial segregation thereof. The chips 9 slide onto the surface 15 of the water 7 with the flat sides of the chips contacting the surface 15 thereof. This is desirable so that the surface 15 of the water 7 which is flowing with a surface speed of approximately 150 ft/min is not broken and the chips 9 then float on the water surface 15 rather than in the water 7.

The compaction of the chips is accomplished by controlling the surface flow rate of the liquid 7. The flow rate of the liquid may be reduced by increasing the liquid depth and by use of appropriate baffles if desired.

Figure 2:
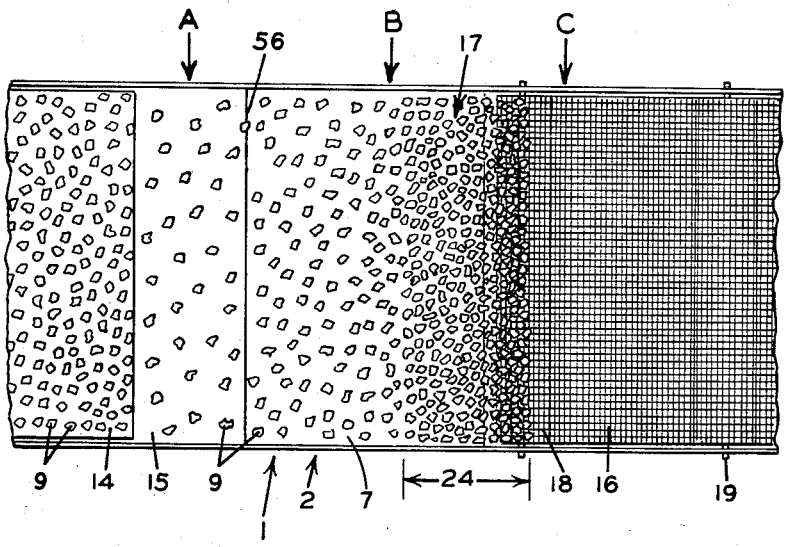
FIG. 2 is a diagrammatic plan view of a portion of the apparatus of FIG. 1.

Section A of the tank 2 is relatively shallow. The flow rate of the water 7 in this section of the tank 2 is approximately 150 ft/min. causing the chips 9 to float on the surface 15 thereof in a widely dispersed manner as best seen in FIG. 2. As the water makes the transition from the shallow section A of the tank 2 to the deeper section B thereof at point 56, the flow rate of the water is rapidly reduced to approximately 60 ft/min and the chips which were widely dispersed (See FIG. 2) become more closely packed. The endless porous web 16 in section C of tank 2 further reduces the surface flow rate of the water to approximately the speed of the endless porous web 16, i.e., line speed. Due to the gradual decrease in water surface speed, the chips 9, as shown in FIG. 2, form into a tightly packed arrangement 17 in which they are substantially in edge-to-edge contact with each other in front of the endless porous take-off web 16.

This embodiment of the invention will be described in relation to the making of a vinyl-type surface covering. In such a surface covering, the decorative chips may be produced from plasticized polyvinyl chloride or a vinyl chloride-vinyl acetate copolymerized product or other suitable materials. Combinations of PVC and synthetic rubber and mixtures of various sorts may also be used. Although this embodiment involves the use of thin unfilled vinyl decorative chips which may be transparent, translucent, opaque, or a mixture thereof, the invention is by no means limited thereto. The nature of the material used to make the chips is not critical. The only requirement is that the chips used must be floatable on a liquid upon which they are dispersed and then formed into a tightly packed layer.

According to the method of the present invention the decorative wear surface of the surface covering is formed of a single thickness layer of chips or flakes. The chips are preferably of a size having at least one dimension ranging between 1/32 inch and 1 inch. The maximum thickness of the pattern elements or chips is dependent upon their having a size to mass ratio which will allow them to be supported on the surface of the liquid. The chips may be made from previously calendered sheets which are broken or cut into the desired size and mixed so that a uniform mixture of chip sizes is available throughout the entire design.

As shown in FIGS. 1 and 2, an endless porous web 16 is mounted over rolls 18, 19, 20, 21, and 22. The web 16 extends upwardly at an angle from roll 18 located in portion C of the tank 2 through the water-chip-layer interface. As the web moves in the direction of arrow 23, the chips 9 are attracted to the wet web 16 and are carried thereby in a compacted substantially single-chip-thickness layer 25 out of the water 7. The web 16 is sufficiently porous to allow water to pass through while still retaining an unbroken film of water on the surface thereof. It is important that the feeding and removal rate of the chips 9 are equal, thus maintaining a substantially constant length chip section 24 adjacent the take-off web 16. (See FIG. 2.) The length of this packed section 24 is maintained by adjusting the speed of the chip feeder belt 12 on the chip feeder to supply chips at a rate equal to that of chip removal.

The web 16 with the chip layer 25 thereon then passes over vacuum means 26 where excess water is removed from the web 16 and from around the chips of chip layer 25. A small amount of water is retained beneath the chips to hold them in place. The endless porous belt or web 16 then passes around the bottom roll 20 of a laminator 27, which drives the web, and around idler rolls 21 and 22.

A backing or carrier 29 is provided with a base coat 31 by means of a conventional coating means 30. The base coat 31 which is preferably a plastisol is gelled by passing it through an air impingement oven 32 set at a temperature of about 275° F. A transparent adhesive layer 35 is then applied onto the base coat 31 by a conventional coating means 33 and dried by passing it through oven 34. The layer 35 is then rendered tacky by heat means 36 and passed through the nip of the laminator 27 together with the web 16 with the chip layer 25 thereon. The top roll 51 of the laminator 27 is steel and is steam heated. The bottom roll 20 is of hard rubber. Thus by heat and pressure the chip layer 25 is transferred intact onto the coated surface of the substrate 29.

After transfer of chip layer 25 to the backing 29 the backing with the chips thereon is passed through heating means 37 preparatory to passing it through planishing rolls 38 to smooth the surface of the chip layer 25. The sheet so formed is then coated by means of a reverse roll coater 41 which applies a coating of plastisol 40. Alternatively, other conventional coating means may be used. The coated sheet is then passed beneath a surface treating means 42 which may be a surface smoothing blade 44 which spreads the plastisol 40 over the surfaces 49 of the chips 9 of chip layer 25 and fills the spaces 48 surrounding the chips (see FIG. 3) to provide a clear coat wear layer 47. Alternatively, the surface treating means 42 may comprise an air knife 43 which blows a high velocity blast of air against the plastisol coating 40. This moves some of the plastisol 40 out of the spaces 48 surrounding the chips onto the surfaces thereof to produce a more textured or more embossed surface (see FIG. 4) having raised portions 52 which are substantially uniplanar and depressed portions 53 which are substantially uniplanar and below the surfaces of the raised portions 52 and the surfaces of the chips, the height of the embossing being approximately equal to the thickness of the chips 9. The surface covering so formed is then passed through an oven 45 and subjected to heat at a temperature of about 375°–400° F. to fuse the resinous clear wear coating 47 and result in the product 46.

Figure 3:
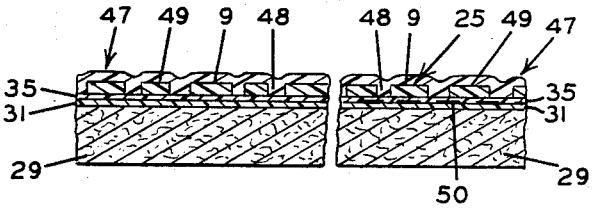
FIG. 3 is a broken enlarged sectional view showing two portions of the product formed by the process of this invention; illustrating the product with and without decorations on the base coat thereof.

In FIG. 3 of the drawings, the surface covering produced by the process of this invention is illustrated in a two-part sectional view, showing the product with and without decorations or printing on the base coat thereof. As shown in FIG. 3, the product comprises a backing 29 which may be made of any of the materials conventionally used for this purpose. The base coat 31 applied to the backing 29 may comprise a a non-foamable vinyl plastisol applied in a thickness in the range of about 1 to 5 mils, or a foamable plastisol having a thickness in the range of from about 5 to 25 mils. However, other conventional base coats may also be used. The base coat 31 may be decorated by printing as shown at 50, if desired, and may be pigmented to make the backing invisible and further serve as a background color which may be seen in the spaces 48 between the chips 9 or, if the chips 9 are transparent, may be seen through the chips. A transparent adhesive layer 35 is then applied at a thickness which may be in the range of from about 0.2 mil to 2 mils to cover the base coat 31. The chip layer 25 is adhered to the layer 35. An overall transparent wear layer 47 extends over the chip layer 25 and into the spaces 48 between the chips 9 thereof and is smoothed by blade 44 (see FIG. 2) prior to fusion.

Figure 4:
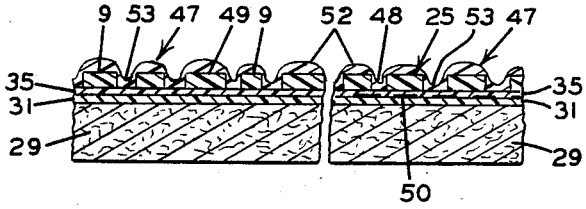
FIG. 4, is an enlarged sectional view of the portions of the product shown in FIG. 3 and illustrating the product as it would appear after some of the wear layer was moved from between the chips and onto the surfaces thereof.

The product shown by FIG. 4 of the drawings is similar to the structure shown in FIG. 3 except that, in the structure of FIG. 4, the clear wear layer 47 instead of being smoothed prior to fusion, has been substantially removed from the spaces 48 between the chips 9 of the layer 25 by blowing a high velocity air blast thereagainst by means of air knife 43 (see FIG. 2), and moved onto the surfaces 49 of the chips 9 thus creating a more textured, embossed wear surface wherein the embossing is in register with the chips.

Products produced in accordance with the invention have a very decorative and durable wearing surface. When unfilled transparent or transluscent chips are used, new styling visuals may be achieved when they are affixed onto decorated backings. Additional styling visuals may also be achieved through the use of jaspe chips. Embossed wear layers increase the decorative effect of the surface coverings and further give the wear layer a three-dimensional appearance. The following examples are given to illustrate the invention:

EXAMPLE I

A non-foamable plastisol of the following formulation

| | % by Weight |
|---|---|
| Texanol isobutyrate plasticizer | 11.49 |
| Di (2-ethylhexyl) phthalate plasticizer | 16.63 |
| Mark 275 Organotin stabilizer | .47 |
| Dispersion grade PVC resin (inherent viscosity 1.00) | 51.33 |
| Limestone filler (325 mesh) | 20.08 |

was applied to a thickness of about 4 mils onto an 0.032 inch gauge (thick) flooring felt backing and gelled at 320° F. for 1 minute in an air impingement oven. This plastisol was pigmented at a level of 2% by weight to achieve the desired color and opacity.

Next a layer of heat-sensitive adhesive having the following composition

| | % by Weight |
|---|---|
| Thermoplastic polyurethane polymer resin (Estane 5712) | 9.81 |
| Silica | 1.96 |
| Methyl ethyl ketone | 88.22 |
| Optical brightener (Uvitex OV) | .0094 |

was applied to a wet thickness of about 1.5 mils, using a reverse roll coater, then dried in a low temperature (250° F.) air impingement oven.

A layer of 8 mil thick vinyl chips of the following composition

| | phr |
|---|---|
| General Purpose PVC resin (Hooker B-282) | 100 |
| Dioctyl phthalate plasticizer | 30 |
| Mark 275 Organotin stabilizer | 2 |
| Stearic Acid | .25 |
| Pigment | 2 |

was then formed by means of flotation and carried on an endless 70 mesh woven polyester web. The monolayer of chips was then transferred from the web to the adhesive coated substrate by heating the substrate with radiant heat and passing it, face down against the chip layer, through a roll laminator. The top roll of the laminator is steel and is steam heated. The bottom roll is hard rubber (80 Shore A).

The substrate containing the chip layer was next carried between two radiant heat sources and heated to a surface temperature of 310°–330° F. It then passed through a roll laminator utilizing a cooled steel roll roll on top and a rubber roll (65 Shore A) on the bottom. This operation serves to planish the surface of the chip layer to a smoothness that is suitable for subsequent coating.

Finally a plastisol layer of the following formulation

| | phr |
|---|---|
| Vinyl chloride dispersion resin (Stauffer SCC NV2) | 41 |
| Vinyl chloride dispersion resin (Tenneco 1755) | 53 |
| Vinyl chloride blending resin (Borden 260 SS) | 6 |
| Primary plasticizer (dioctyl phthalate) | 13.5 |
| Secondary plasticizer (Texanol Isobutyrate) | 17.5 |
| Primary plasticizer (Santicizer S-160) | 10 |
| Secondary plasticizer epoxidized soybean oil (Admex 710) | 3 |
| Viscosity Control Agent (Solvesso 150) | 5 |
| Stabilizer (18% Zinc octoate) | .2 |
| Stabilizer (15% Barium neodecanoate) | .4 |

was applied over the chip layer to a thickness of 3–5 mils by a reverse roll coater to fill the interstices around the chips with plastisol and add an additional vinyl layer over the chips themselves. The surface of the plastisol layer was then leveled by passing it beneath a smoothing blade. Fusion of all resinous material was then accomplished by passing the composite structure through an air impingement oven at a temperature of 375°–400° F.

EXAMPLE II

The same materials and process steps as set forth in Example I were followed except that, after the final plastisol layer was applied it was subjected to a high velocity blast of air to move some of the plastisol from between the chips onto the surfaces thereof to produce a more textured or embossed surface.

What is claimed is:

1. A method for forming a surface covering having a tightly packed single layer of decorative chips on the surface thereof, comprising:
   (a) providing a body of liquid of lesser density than that of the decorative chips and flowing from a first location to a second location;
   (b) providing a plurality of decorative chips having a size-to-mass ratio such that they are capable of floating on the surface of said body of liquid;
   (c) feeding said chips onto the surface of said liquid at said first location at a rate and in amounts predetermined to result in a spaced-apart dispersion of the chips thereon;
   (d) reducing the rate of flow of said liquid at said second location, thereby causing said chips to form a tightly-packed single-chip-thickness layer on the surface of the liquid;
   (e) removing said tightly packed layer of chips from said liquid at said second location without causing any substantial change in the spacing of the chips with respect to each other, said tightly packed layer of chips is removed from the liquid at said second location by passing a porous support member upward at an angle from below the surface thereof through the chip-layer-innerface, wherein excess water is removed from the support member and from around the chips prior to their securement to the substrate;
   (f) applying and securing said layer of chips to a substrate;
   (g) applying a transparent resinous wear layer to cover said chips and extend into any spaces therebetween; and
   (h) applying heat to fuse all resinous material.

2. The method for forming a surface covering according to claim 1 wherein the resinous wear layer is a vinyl resin plastisol which, after application is moved from the spaces between the chips onto the top surfaces thereof by means of high velocity air pressure thus providing an embossed wear surface wherein the embossing is in registration with the chips.

* * * * *